US009016025B2

(12) United States Patent
Jin et al.

(10) Patent No.: US 9,016,025 B2
(45) Date of Patent: Apr. 28, 2015

(54) CONSTRUCTING METHOD FOR CONCRETE CYLINDER OF CONSTRUCTION STEEL BAR OF HIGH-RISE STEEL STRUCTURE

(75) Inventors: Rui Jin, Hangzhou (CN); Chuanming Zhai, Hangzhou (CN); Bo Chang, Hangzhou (CN); Qiang Hu, Hangzhou (CN); Fei Wu, Hangzhou (CN); Jinghui Ping, Hangzhou (CN); Wei Xu, Hangzhou (CN)

(73) Assignee: Zhejiang Construction Engineering Group Co., Ltd, Hangzhou, Zhejiang (CN)

( * ) Notice: Subject to any disclaimer, the term of this patent is extended or adjusted under 35 U.S.C. 154(b) by 0 days.

(21) Appl. No.: 14/352,023

(22) PCT Filed: Jun. 11, 2012

(86) PCT No.: PCT/CN2012/076718

§ 371 (c)(1),
(2), (4) Date: Apr. 15, 2014

(87) PCT Pub. No.: WO2013/185277

PCT Pub. Date: Dec. 19, 2013

(65) Prior Publication Data

US 2014/0305070 A1 Oct. 16, 2014

(51) Int. Cl.
*E04B 1/00* (2006.01)
*E04G 11/28* (2006.01)
*E04B 2/84* (2006.01)

(52) U.S. Cl.
CPC .. *E04G 11/28* (2013.01); *E04B 2/84* (2013.01)

(58) Field of Classification Search
CPC ..... E04G 13/00; E04G 17/18
USPC ..... 52/742.14, 651.1; 182/142, 145
See application file for complete search history.

(56) References Cited

U.S. PATENT DOCUMENTS 598,294 A * 2/1898 Robbins ..... 182/142
1,432,040 A * 10/1922 Schuler ..... 182/145

(Continued)

FOREIGN PATENT DOCUMENTS

CN 101936067 A 1/2011
CN 202000659 U 10/2011
CN 202055517 U 11/2011

OTHER PUBLICATIONS

Xing, Xiangdong et al., Application of JFYM50 hydraulic climbing formwork in tall buildings, *Zhejiang Construction*, Aug. 2007, vol. 24, No. 8, pp. 58-61, ISSN 1008-3707.

(Continued)

*Primary Examiner* — Basil Katcheves
(74) *Attorney, Agent, or Firm* — Muncy, Geissler, Olds & Lowe, P.C.

(57) ABSTRACT

A constructing method for a concrete cylinder of a construction steel bar of a high-rise steel structure adopts a constructing method of supporting inside and climbing outside. The outside of the cylinder adopts hydraulic mutual-climbing adhesive lifting scaffold creeping formwork system (100), and also has an outside wallboard mechanical formwork erection function and an outer frame protection function. For the inside of the cylinder, except that an appropriate structure is left for later processing according to a schedule requirement, beam walls all adopt a steel cylinder support to perform formwork erection, so as to greatly reduce the workload of repeatedly mounting/dismantling the scaffold and the formwork at a high place. The scaffold itself carries the formwork erection system, so formwork erection and formwork removal can be mechanized, thereby reducing the risk of formwork erection and formwork removal at a high place.

1 Claim, 8 Drawing Sheets

(56) References Cited

U.S. PATENT DOCUMENTS

| | | | | | |
|---|---|---|---|---|---|
| 2,543,348 | A | * | 2/1951 | Briese | 114/222 |
| 2,814,533 | A | * | 11/1957 | Van Horn | 182/14 |
| 4,234,055 | A | * | 11/1980 | Beeche | 182/142 |
| 4,378,860 | A | | 4/1983 | Newberry | |
| 4,396,092 | A | * | 8/1983 | Thompson | 182/38 |
| 5,411,112 | A | * | 5/1995 | Jephcott | 182/84 |

OTHER PUBLICATIONS

Gu, Wenhui et al., Application of Auto-climbing formwork in core-tube of some tall buildings, *Construction Technology*, Sep. 2011, vol. 40, No. 349, pp. 72-76, ISSN 1002-8498.

* cited by examiner

CONSTRUCTING METHOD FOR CONCRETE CYLINDER OF CONSTRUCTION STEEL BAR OF HIGH-RISE STEEL STRUCTURE

FIELD OF THE INVENTION

The present invention belongs to the field of building construction, in particular to a constructing method for a concrete cylinder of a construction steel bar of a high-rise steel structure.

BACKGROUND OF THE INVENTION

The current common high-rise steel structure system is typically in the form of steel frame-core cylinder, namely: concrete filled steel tubular columns and steel beams constitute a structural frame, profiled steel sheet-concrete composite slabs, self-supporting slabs and reinforced concrete slabs together serve as a floor system, and a reinforced concrete core cylinder is used as a structural unit for enhancing the horizontal stiffness of a building. Deep research and summarization on a complete set of construction technologies of such structural systems can provide a powerful technical support for safe, high-quality and fast project construction.

In conventional construction methods for a high-rise steel structure building reinforced concrete cylinder, a steel cylinder fastener-type cantilever scaffold is used for protection at the outer side of the cylinder and a steel cylinder fastener-type formwork support structure is used at the inner side, which results in such obvious defects as high risk in high-altitude setup and removal operations, poor wallboard forming quality caused by unstable outer wall formwork supporting system, and high transportation pressure caused by frequent material circulation, etc.

Mainly adopted in the current construction of the high-rise steel structure building reinforced concrete cylinder is a method in which a steel cylinder fastener-type cantilever scaffold is used for protection at the outer side of the cylinder and a steel cylinder fastener-type formwork support structure is used at the inner side. The common procedure is that: at first, cantilever channel steel is embedded, the cantilever scaffold is set up, the steel bars of a shear wall of the cylinder are bound, a beam slab formwork support at the inner side of the cylinder is set up and a wallboard inside formwork is supported, then a wallboard outside formwork of the cylinder is supported by the cantilever scaffold, and finally, the steel bars of the beam slab structure of the cylinder are bound and concrete is cast and compacted. The conventional method adopted has the defects below:

1. In the conventional cylinder construction method, the steel cylinder fastener-type cantilever scaffold is used for protection and needs to be set up and removed repeatedly at high altitude, so there is a high safety risk in high-altitude operations and a high pressure of vertical material transportation; especially, in the case that a structure of steel tubular column+steel beam+profiled steel sheet composite slab is adopted at the periphery, plenty of contradictions could arise between hoisting of steel structure members and vertical material transportation.

2. In the conventional cylinder construction method, for the outer wall formwork of the cylinder, the steel cylinder fastener-type formwork structure is supported on the scaffold in an assembling manner, causing the defects like poor stability and poor wall surface forming quality of the cylinder 3. In the conventional cylinder construction method, those materials for the outer wall of the cylinder, such as formworks and steel cylinders, are all piled up on the cantilever scaffold, which can easily lead to overload, loss of scaffold stability and other accidents, so a high safety risk exists.

4. In the conventional cylinder construction method, the outer wall formwork, the steel cylinders of the cantilever scaffold and other materials are hoisted down to the ground by a tower crane after dismantled, and then hoisted up to the working floor when formwork closure or setup is carried out once again, as a result, a high pressure of vertical material transportation is generated to affect the construction progress negatively.

5. The conventional cylinder construction method is inconvenient in material circulation and vertical material transportation, leading to slow construction progress.

Therefore, there is an urgent need to find a construction method for safe, high-quality and fast construction of a high-rise reinforced concrete core cylinder.

SUMMARY OF THE INVENTION

To overcome the above defects in the existing construction method for a reinforced concrete core cylinder, provided in the present invention is a constructing method for a concrete cylinder of a construction steel bar of a high-rise steel structure, which is not only capable of ensuring safe construction and good project quality, but also fast in construction.

The technical solution of the present invention is as follows:

A constructing method for a concrete cylinder of a construction steel bar of a high-rise steel structure is characterized by comprising:

(1) Arranging a hydraulic mutual-type adhesive lifting scaffold creeping formwork system, wherein the climbing formwork system comprises an attaching device, an H-shaped guide rail, a scaffold body, a large formwork supporting system, a large formwork moving trolley, a climbing mechanism, an electro-control hydraulic lifting system, anti-overturning and anti-falling devices and a safeguard system;

(2) Manufacturing an outer wall steel back ridge plywood large formwork of the cylinder;

(3) Mounting the climbing formwork system at the outer side of the cylinder;

(4) Binding the wallboard steel bars of the cylinder;

(5) Mounting a wallboard inside formwork and a beam slab formwork of the cylinder, wherein the wallboard inside formwork has back ridges;

(6) The climbing formwork system climbing at the outer side of the cylinder, mounting a wallboard outside formwork of the cylinder, and closing the wallboard inside and outside formworks, wherein the wallboard outside formwork of the cylinder is the outer wall steel back ridge plywood large formwork;

(7) Binding the steel bars of the beam slab; and (8) Carrying out concrete casting and compacting as well as concrete curing on the wallboard and the beam slab of the cylinder;

The span of two adjacent positions is not more than 6 meters when the climbing formwork system is arranged linearly, and is not greater than 5.4 meters when the climbing formwork system is arranged in the form of a fold line or a curve; the scaffold body is either integrated or assembled, the cantilever length of the scaffold body is smaller than a half of the span of the scaffold body and must be not greater than 3 meters when the scaffold body is integrated and is not greater than ¼ of the span when the scaffold body is assembled; the total height of the scaffold body is 16 meters, which meets the requirement of an enclosure of 3.5-4 standard layers and the construction requirement;

The outer wall steel back ridge plywood large formwork in step 2 is manufactured in such a manner that 10# channel steel and a square timber with a size of 100 mm×100 mm are used as back ridges to cover a plywood with a size of 915 mm×1830 mm×18 mm, and a square timber with a size of 48 mm×70 mm is held at the joint of the large formwork;

In step 3, the H-shaped guide rail and the scaffold body of the climbing formwork system are mounted on the wallboard of the cylinder by the attaching device, so as to complete mounting of the climbing formwork system; the attaching device comprises an embedded steel sleeve, a crossing bolt and a wall-attaching device; step of mounting the scaffold body of the climbing formwork system by the attaching device is as follows: if the climbing formwork system needs to be mounted on a certain layer of the cylinder, a steel sleeve with a size of Φ60 mm×2.5 mm is embedded at the location 600 mm below structural floor when the steel bars of the wallboard or the beam slab at this layer are bound, the steel sleeve is filled with foams, two ends of the steel sleeve are sealed by adhesive tapes, and the length of the steel sleeve is identical to the thickness of the wallboard at the embedment location; after the civil structure of this layer is finished, an M48 crossing bolt is mounted at the embedded steel sleeve once the compressive strength of concrete reaches 10 Mpa or above, the inner side of the crossing bolt is fixed on the wallboard of the cylinder through a nut, the outer side of the crossing bolt is fixed with the wall-attaching device through a nut; and the H-shaped guide rail and the scaffold body of the climbing formwork system are fixed at the outer side of the wallboard of the cylinder at this layer by the wall-attaching device;

Binding the wallboard steel bars in step 4 is implemented by using the scaffold body of the climbing formwork system as an operating frame;

The support structure for the wallboard inside formwork and the beam slab formwork in step 5 is set up using a steel cylinder fastener-type scaffold, and both the wallboard inside formwork and the beam slab formwork are plywoods;

Step 6 specifically comprises: after the strength of the outer wall concrete of the cylinder at the lower layer meets the requirement of formwork stripping and the compressive strength reaches 10 Mpa or above, the wallboard outside formwork is horizontally moved out of this layer by moving the large formwork moving trolley of the climbing formwork system, and the crossing bolt and the wall-attaching device are mounted at the location of the embedded steel sleeve at this layer, afterwards, the electro-control hydraulic lifting system is operated to enable the H-shaped guide rail to climb from the next lower layer to this layer and to be fixed with the wall-attaching device at this layer, then the electro-control hydraulic lifting system is operated again to also enable the scaffold body to climb up by one layer along the H-shaped guide rail through the climbing mechanism and to be fixed with the wall-attaching device, the wallboard outside formwork correspondingly ascends from the lower layer to the upper layer at which the steel bars are properly bound, the large formwork moving trolley is moved to horizontally move the wallboard outside formwork towards the wallboard, closing of the wallboard inside and outside formworks is completed when the wallboard outside formwork is moved to a designated location, and during closing, the outer wall steel back ridge plywood large formwork is connected and fixed with the back ridges on the wallboard inside formwork of the cylinder by a crossing bolt having a diameter Φ of 12 mm;

Binding the steel bars of the beam slab of the cylinder in step 7 is implemented by using the scaffold body of the climbing formwork system as a circumferential protection frame.

The method of the present invention is an internal-supporting and external-climbing type construction method for a high-rise reinforced concrete core cylinder structure. A climbing formwork device having the functions of both mechanized formwork supporting of an outer side wallboard and external scaffold protection is adopted at the outer side of the cylinder, and steel cylinder supports are adopted for formwork supporting in all beam slab walls except that a proper structure at the inner side of the cylinder is retained according to the progress requirement for future construction, in this way, the "internal-supporting and external-climbing" construction method is generated. According to the internal-supporting and external-climbing construction method, the climbing formwork system is used at the outer side of the cylinder, so as to realize climbing to the top directly after one-step mounting and protection, thus the high-altitude operation risk of multiple reversals and setups and the falling risk in the conventional cantilever scaffold methods are effectively avoided. And the technology of mechanized climbing formwork at the outer side of the cylinder and the mature technology of formwork supporting by the supports at the inner side are combined in the internal-supporting and external-climbing construction method, the construction progress can be as high as 3-5 days per layer (standard layer) and 5-7 days per layer (nonstandard layer), furthermore, the structural quality level of this construction method is better than that of the conventional technology. During cylinder construction, the formed large formworks and the external scaffold are combined together to accomplish integrated climbing, which effectively reduces the workload of high-altitude hoisting and assembly and disassembly of revolving materials, like formworks and steel cylinders, and alleviates a contradiction in use of the tower crane during steel structure hoisting. The formwork at the outer side of the cylinder is a self-made steel frame back ridge large formwork with a wooden faceplate; except the faceplate, the steel frame can be recycled in different cylinders after modification; and compared with conventional full-steel large formwork, the deadweight of this large formwork is significantly reduced, and the cost can be lowered dramatically.

The internal-supporting and external-climbing construction method of the present invention solves the construction problems in the prior art, overcomes various hidden dangers that need to be prevented in common construction, has outstanding technical advantages, and is capable of ensuring safe construction and increasing construction speed. The construction method is applicable to construction of the high-rise reinforced concrete core cylinder structure.

The present invention has the technical effects below:

1. Safe high-altitude operations.

2. Stable formwork system and good structure forming quality.

3. Reduction of vertical material transportation frequency and more reasonable use of mechanical equipment.

4. Safe and effective acceleration of the construction progress.

5. Considerable economical benefit owing to convenient recycling of the channel steel back ridge large formworks and use of a small number of steel cylinder fasteners.

For further description of the structural features and effects of the present invention, it will be further described below in conjunction with the accompanying drawings.

DETAILED DESCRIPTION OF THE EMBODIMENTS

Figure 1:
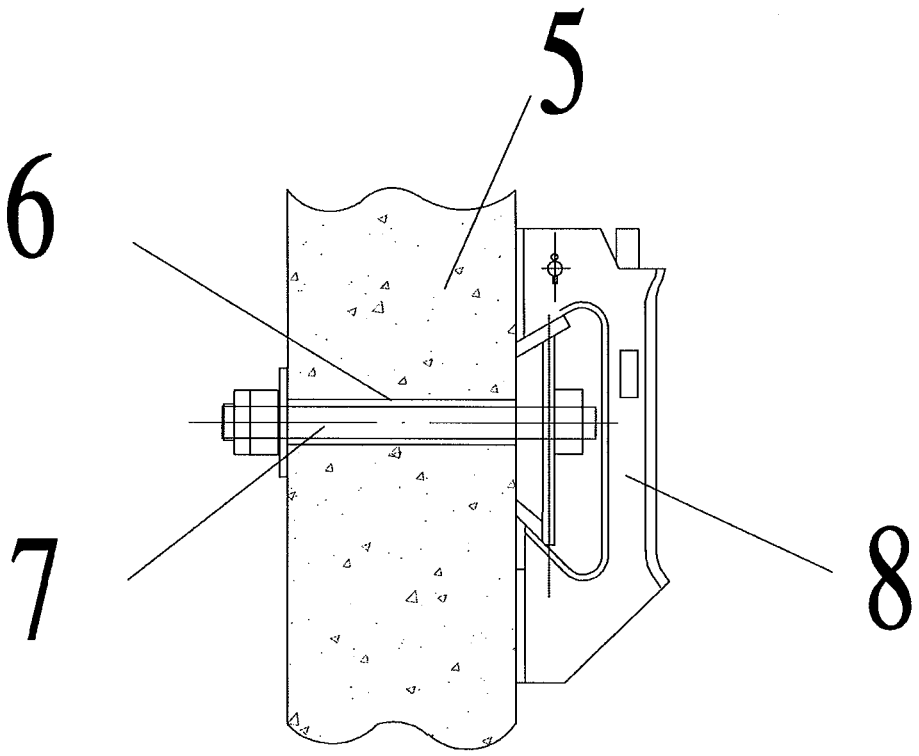
FIG. 1 is a schematic view of the attaching device.
Figure 2:
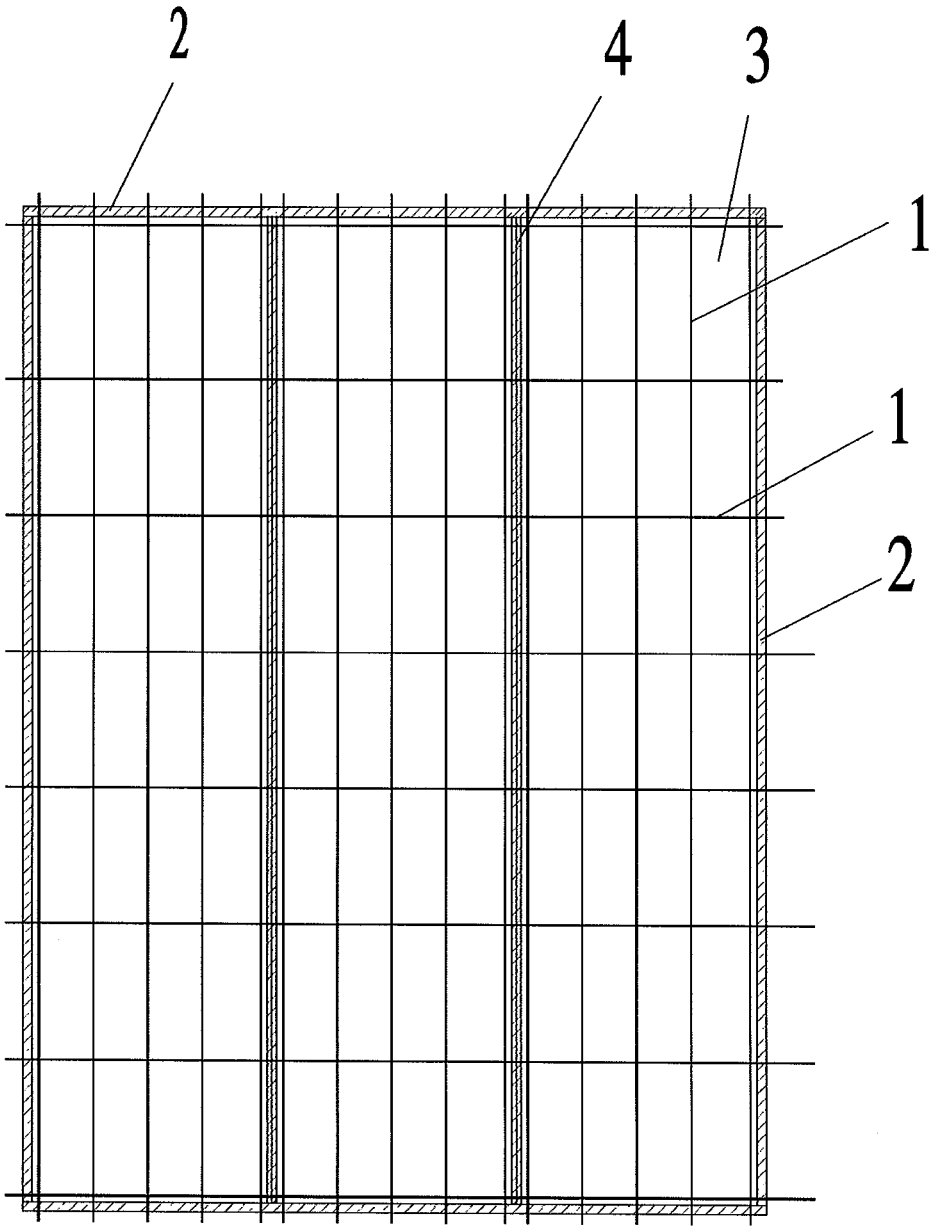
FIG. 2 is an elevation view of the steel back ridge plywood large formwork.
Figure 3:
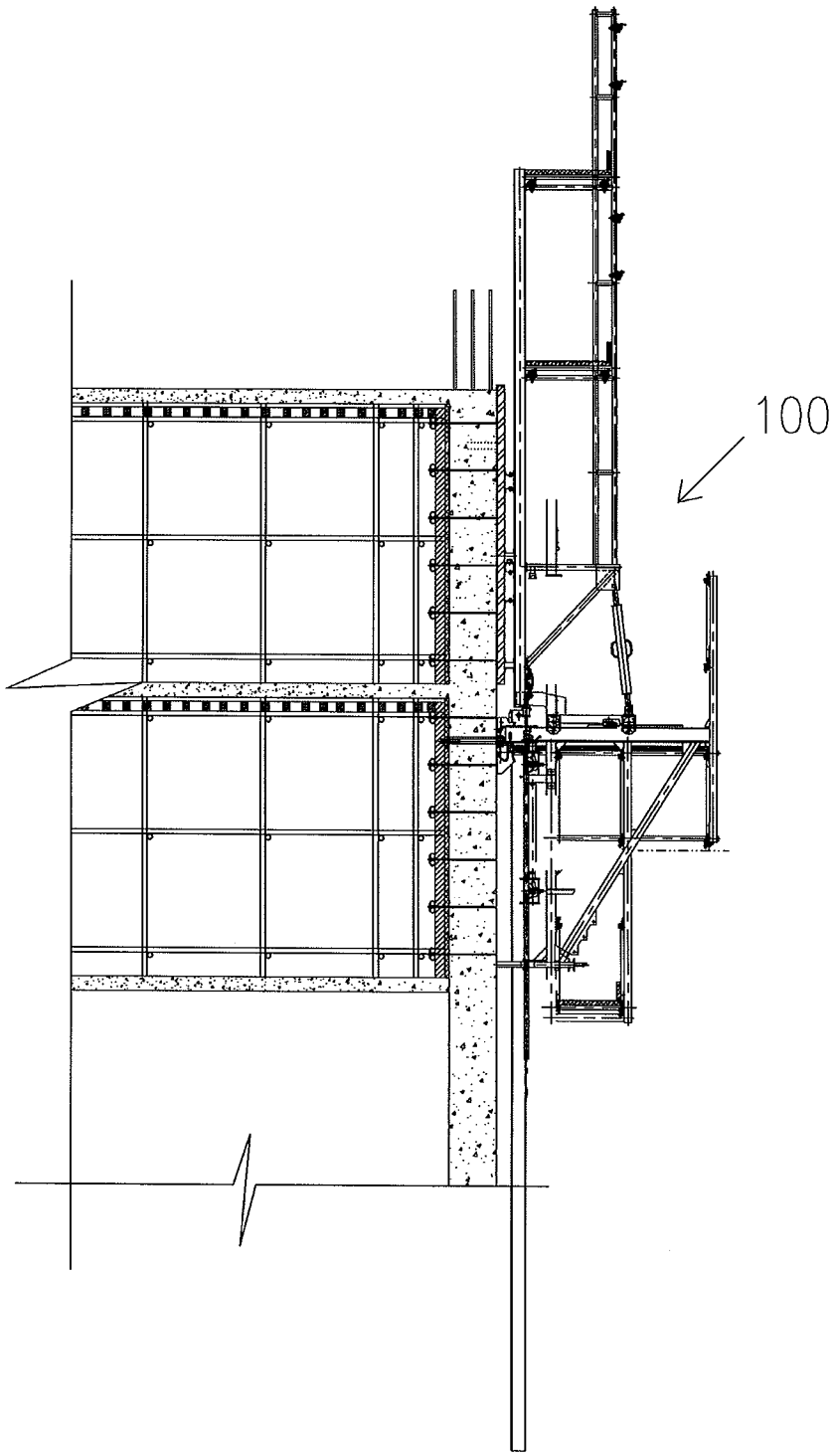
FIG. 3 is an elevation view of the cylinder with the climbing formwork system mounted thereon.
Figure 4:
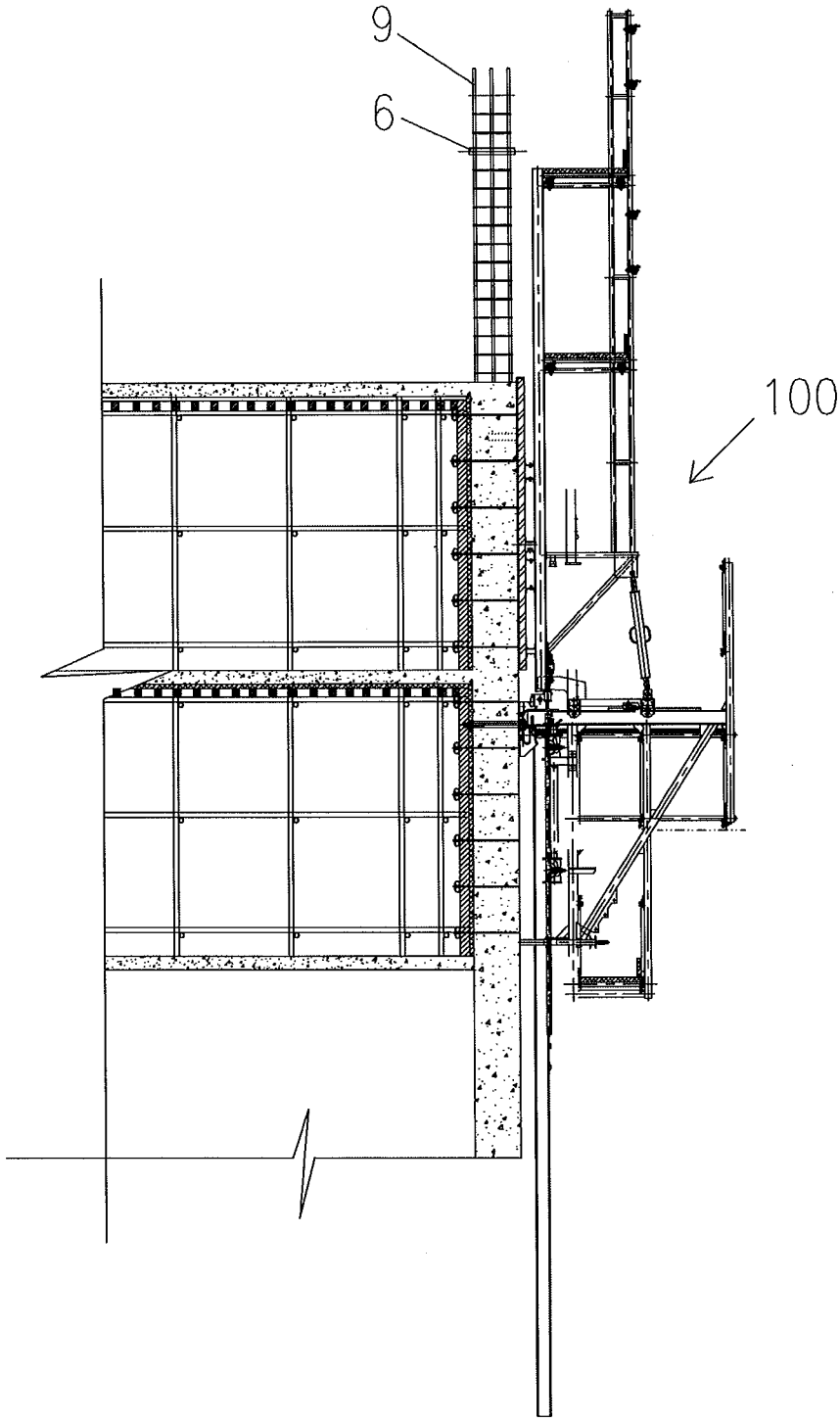
FIG. 4 is an elevation view, illustrating the wallboard steel bars of the cylinder are properly bound.
Figure 5:
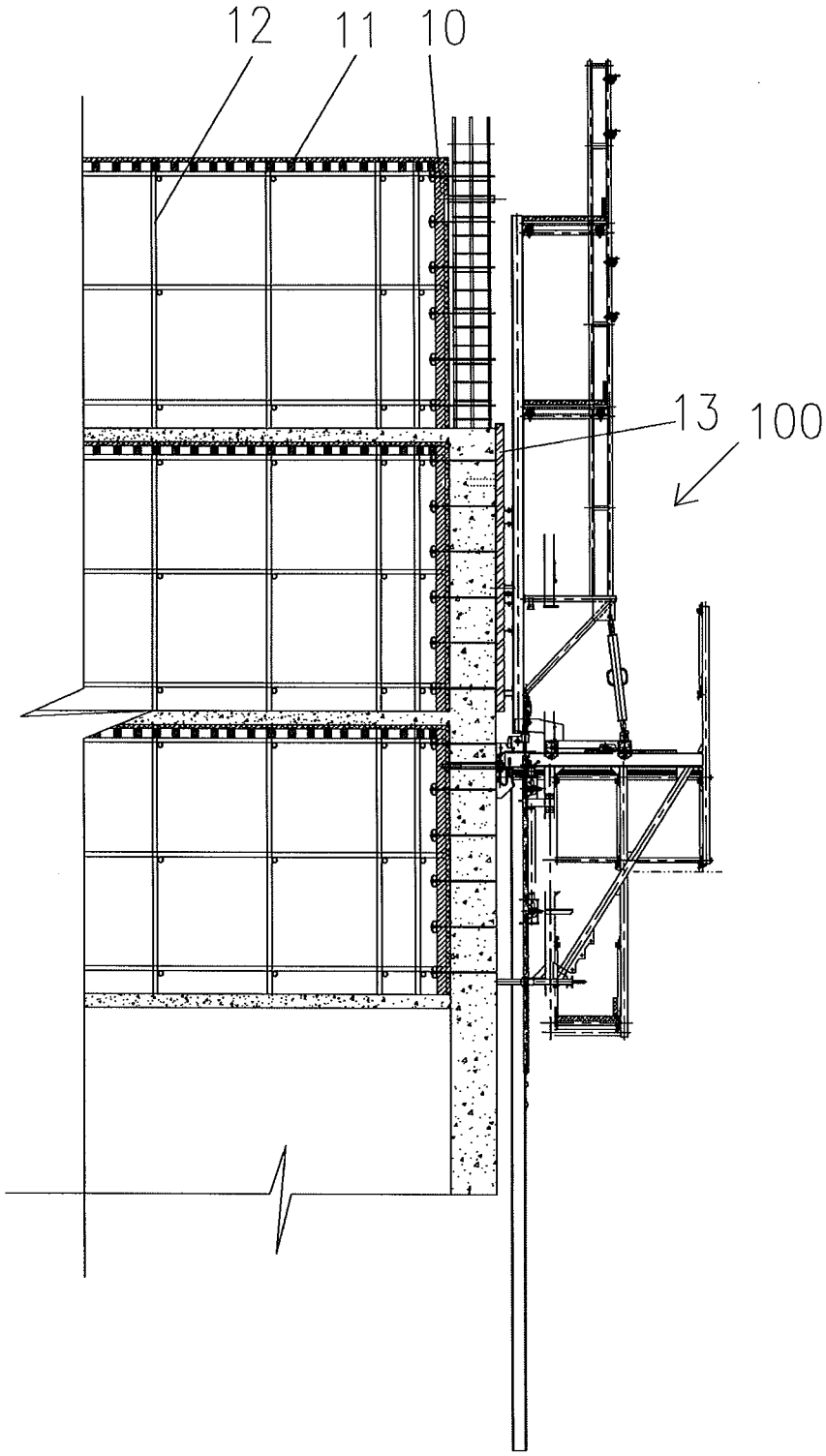
FIG. 5 is an elevation view, illustrating the wallboard inside formwork and the beam slab formwork of the cylinder are properly mounted.
Figure 6:
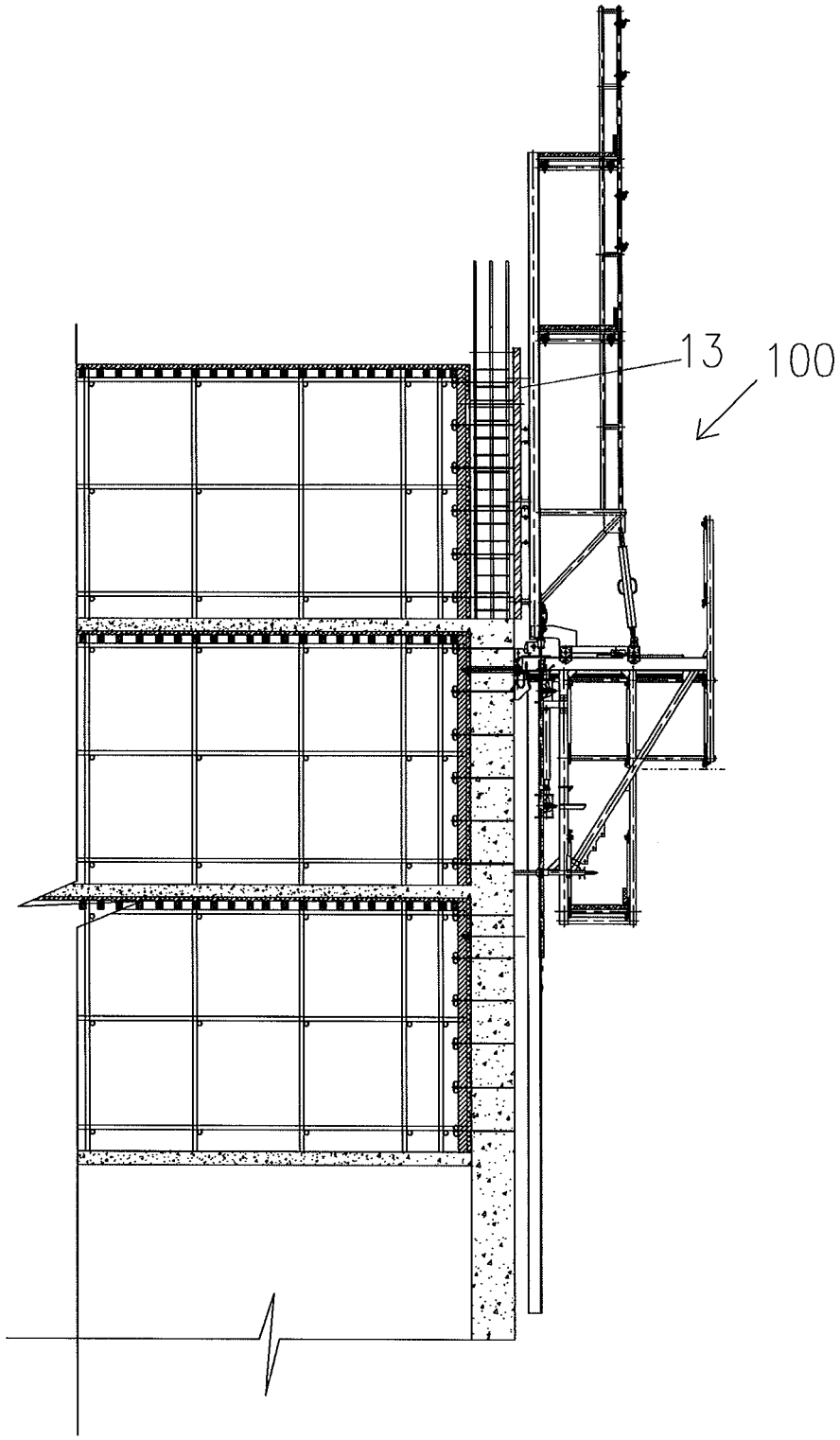
FIG. 6 is a schematic view, illustrating closing of the wallboard inside and outside formworks of the cylinder after the climbing formwork system climbs up by one layer.
Figure 7:
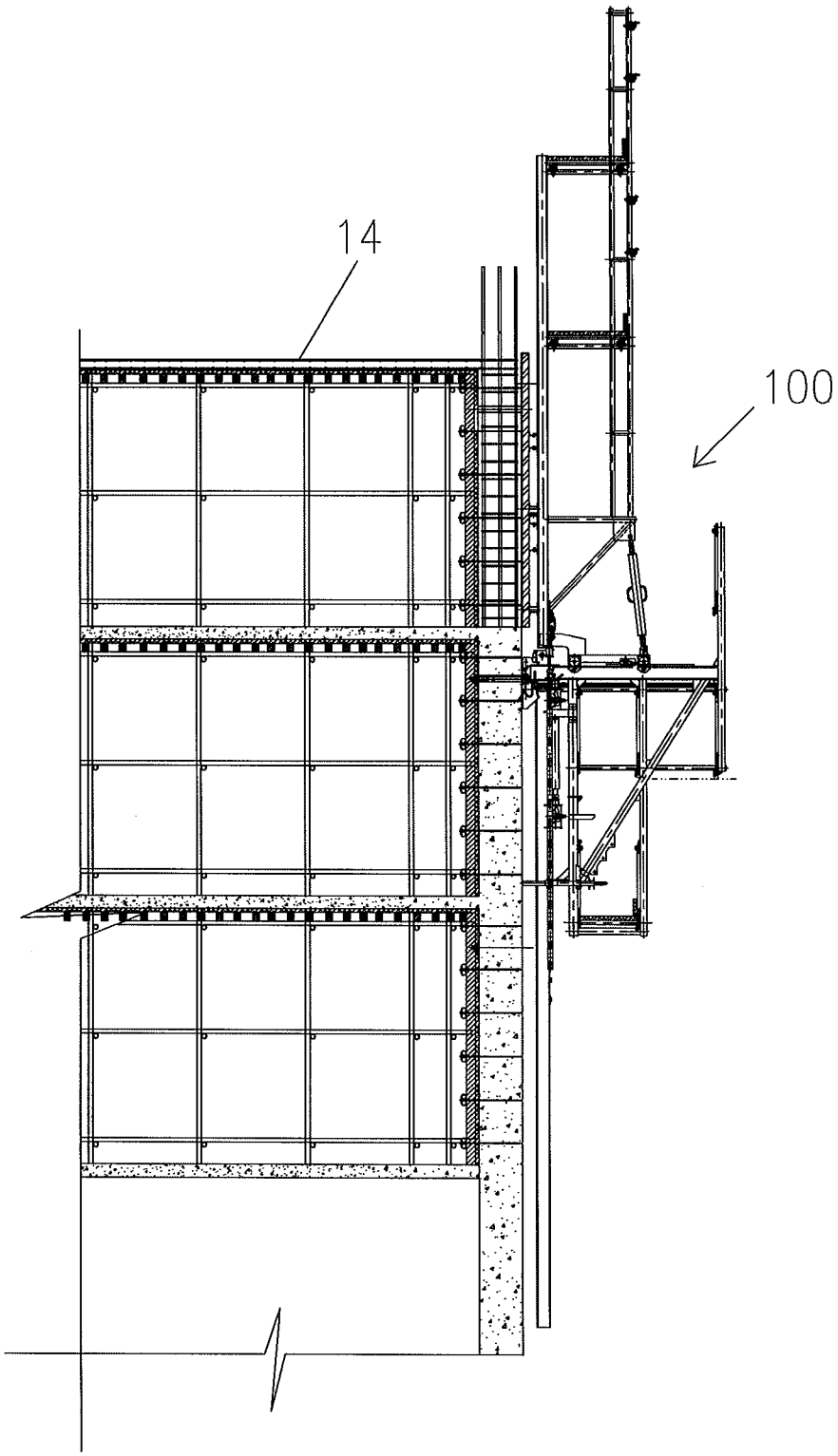
FIG. 7 is an elevation view, illustrating the steel bars of the beam slab are properly bound.
Figure 8:
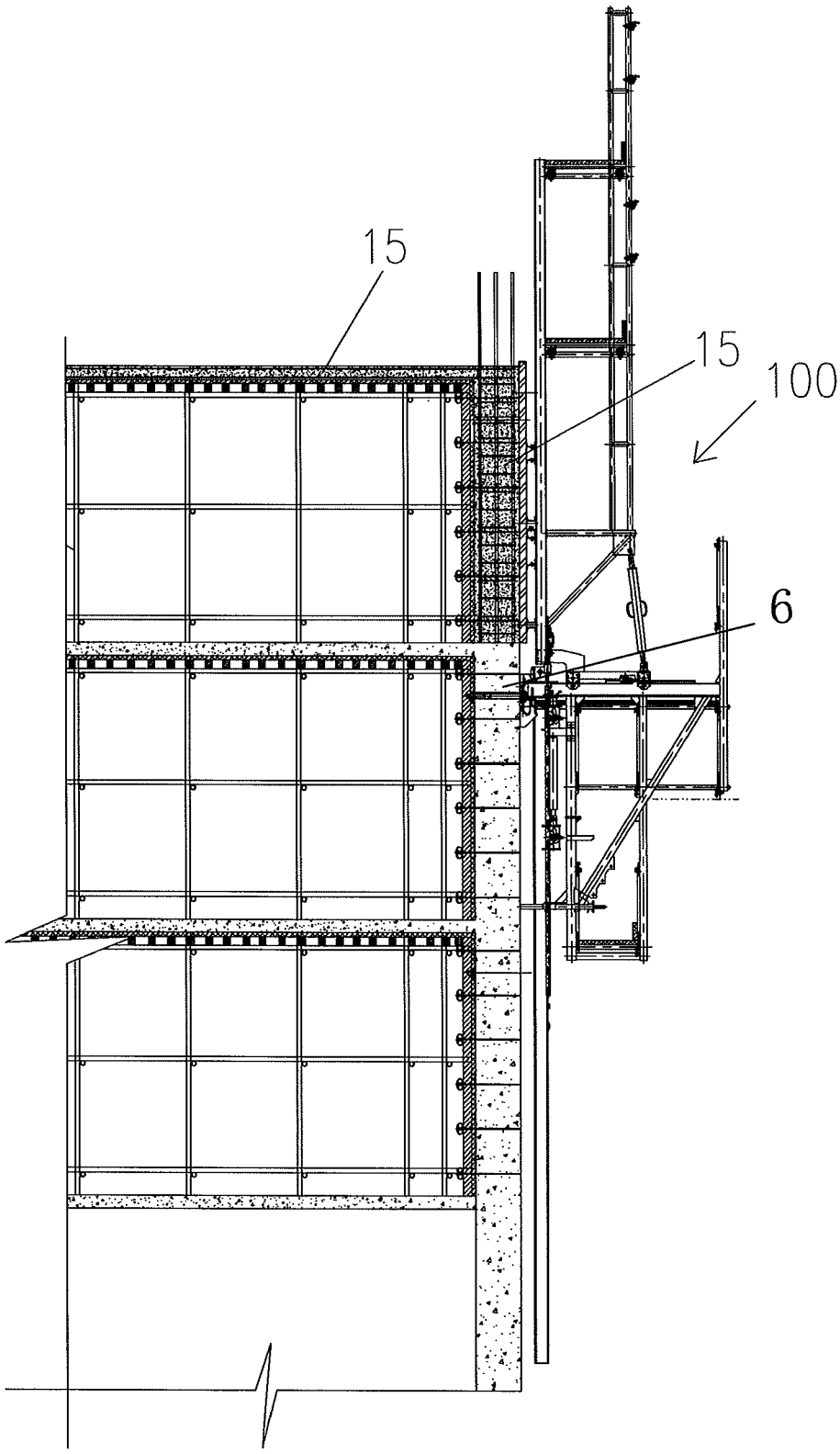
FIG. 8 is an elevation view, illustrating wallboard and beam slab concrete is properly cast.

As shown in FIG. 1 to FIG. 3, a constructing method for a concrete cylinder of a construction steel bar of a high-rise steel structure specifically comprises:

(1) Arranging a hydraulic mutual-type adhesive lifting scaffold creeping formwork system 100. The climbing formwork system comprises an attaching device, an H-shaped guide rail, a scaffold body, a large formwork supporting system, a large formwork moving trolley, a climbing mechanism, an electro-control hydraulic lifting system, anti-overturning and anti-falling devices and a safeguard system. It should be noted that, the scaffold body needs to be arranged to meet the construction requirement of every outer wall large formwork and to ensure that every outer wall large formwork has its corresponding and independent supporting system and climbing mechanism. The span of two adjacent positions is not more than 6 meters when the climbing formwork system is arranged linearly, and is not greater than 5.4 meters when the climbing formwork system is arranged in the form of a fold line or a curve; the scaffold body is either integrated or assembled, the cantilever length of the scaffold body is smaller than a half of the span of the scaffold body and must be not greater than 3 meters when the scaffold body is integrated and is not greater than ¼ of the span of the scaffold body when the scaffold body is assembled; the total height of the scaffold body is 16 meters, which meets the requirement of an enclosure of 3.5-4 standard layers and the construction requirement. Meanwhile, load of the scaffold body cannot exceed the lift-up capability of the hydraulic lifting system. As for the embedment location of every position, top priority should be given to the form of crossing screws; steel reinforced concrete columns, steel beams, nail walls and staircases that have a thickness greater than that of a standard wall as well as impenetrable locations should be avoided, and a special embedded climbing cone should be adopted if they are unavoidable.

(2) Designing and manufacturing an outer wall steel back ridge plywood large formwork of the core cylinder. The outer wall steel back ridge plywood large formwork is manufactured in such a manner that 10# channel steel 1 and a square timber 2 with a size of 100 mm×100 mm are used as back ridges to cover a plywood 3 with a size of 915 mm×1830 mm×18 mm, and a square timber 4 with a size of 48 mm×70 mm is held at the joint of the large formworks; the steel back ridge plywood large formwork, after manufactured, is integrally hoisted onto the formwork support of an attached lifting scaffold by a tower crane or other hoisting equipment, and the outer wall steel back ridge plywood large formwork is connected and fixed with the back ridges of the wallboard inside formwork of the cylinder by a crossing bolt having a diameter Φ of 12 mm. Thus, the advantages below are realized: small deadweight, good overall performance in structure, flat wall surface, fast formwork circulation, low one-time investment, small labor intensity, simple operation, convenient construction, etc.

When used on the outer wallboard of the high-rise reinforced concrete core cylinder structure, the steel back ridge plywood large formwork can be used in concert with the attached lifting scaffold at the outer side to form the climbing formwork system. The steel back ridge plywood large formwork is fixed on the formwork support of the attached lifting scaffold, which is capable of moving forwards to achieve formwork closing and provide diagonal bracing for the formwork at the outer side and moving backwards to retreat the formwork, and the formwork is lifted up by the attached lifting scaffold. Such cooperation in use avoids grounding of the large formwork, reduces transportation of the formwork, improves the working efficiency and effectively accelerates the construction period.

(3) Mounting the climbing formwork system at the outer side of the cylinder. The H-shaped guide rail and the scaffold body of the climbing formwork system are mounted on the wallboard 5 of the cylinder by the attaching device, so as to complete mounting of the climbing formwork system; the attaching device comprises an embedded steel sleeve 6, a crossing bolt 7 and a wall-attaching device 8; step of mounting the scaffold body of the climbing formwork system by the attaching device is as follows: if the climbing formwork system needs to be mounted on a certain layer of the cylinder, a steel sleeve with a size of Φ60 mm×2.5 mm is embedded at the location 600 mm below structural floor when the steel bars of the wallboard or the beam slab at this layer are bound, the steel sleeve is filled with foams, two ends of the steel sleeve are sealed by adhesive tapes, and the length of the steel sleeve is identical to the thickness of the wallboard at the embedment location; after the civil structure of this layer is finished, an M48 crossing bolt is mounted at the embedded steel sleeve once the compressive strength of concrete reaches 10 Mpa or above, the inner side of the crossing bolt is fixed on the wallboard of the cylinder through a nut, a space of more than 3 fastening screws must be reserved at the two ends of the crossing bolt after the crossing bolt is tightened, the outer side of the crossing bolt is fixed with the wall-attaching device through a nut; and the H-shaped guide rail and the scaffold body of the climbing formwork system are fixed at the outer side of the wallboard of the cylinder at this layer by the wall-attaching device. The mounting procedure further includes: assembly of the scaffold body on the ground, integrated hoisting of the scaffold body, laying of scaffold boards, suspension of a protection net, and mounting of an electro-control hydraulic device.

Assembly and hoisting of the climbing formwork system: main load-bearing scaffold bodies, the H-shaped guide rail and an up/down climbing box, the large formwork moving trolley and the anti-overturning and anti-falling devices are assembled together before they leave the factory and hoisted by a tower crane into the attaching device on the spot, furthermore, anti-overturning inserted boards are inserted and adjustment support legs at the lower part of the main load-bearing scaffold bodies are caused to get close to the facade of the structural wall, thereby keeping the scaffold bodies perpendicular. The overall perpendicularity of the scaffold bodies should be smaller than 3% and not greater than 50 mm.

After the main load-bearing scaffold bodies are assembled, a horizontal beam frame between the two main load-bearing scaffold bodies is assembled, and is connected to the two ends of the main load-bearing scaffold bodies by M12×35 bolts. Transverse and longitudinal rods are set up at the corresponding locations of the upper and lower web members of the horizontal beam frame and the cantilever scaffold by steel cylinders with a size of Φ48 mm×3.5 mm and steel cylinder fasteners, in order to improve the stability of every scaffold body.

Scaffold boards and toeboards in steps 3 and 4 are laid. An up/down passage hole with a size of 700 mm×700 mm is reserved in the middle of the formwork operating platform of every scaffold body, and the hole is sealed off by an overturning board to avoid workers and items falling off.

To solve the problem that a constructor has to go up and down, a climbing ladder that is formed by welding scaffold cylinders or steel bars can be mounted at the up/down passage hole reserved on the scaffold body at every step. And for safety reasons, the climbing ladders between steps must be mounted in a staggered manner to create a zigzag shape, and handrails are arranged on the climbing ladders.

The formwork supporting system is completely assembled on the ground and then hoisted integrally. Transverse and longitudinal rods are set up at the corresponding locations by steel cylinders with a size of Φ48 mm×3.5 mm and steel cylinder fasteners, in order to improve the stability of every scaffold body.

Scaffold boards and toeboards of the scaffold (civil construction layer) in steps 5, 6 and 7 are laid with a pace of 1.8 m, and rigid tying is formed between the middle of a vertical support and the civil structure.

A climbing formwork hanging frame system is completely assembled on the ground and then hoisted integrally.

A hanging frame is mounted, and connected with the lower part of the main load-bearing scaffold bodies via pin shafts, and transverse and longitudinal rods are set up at the corresponding locations by steel cylinders with a size of Φ48 mm×3.5 mm and steel cylinder fasteners, in order to improve the stability of every scaffold body.

(4) Binding the wall steel bars 9 of the core cylinder. The steel bars are bound in such a sequence: vertical member columns and wall steel bars are bound at first during construction for wall and roof structures, and then the beam slab steer bars of the roof can be bound after setup of an all-round scaffold for the roof and supporting of the beam slab formwork. For a shear wall, spacer bars are bound at first, then tied with wires, classified and gradually bound; staggered binding can be applied to the middle part except the intersection points of two rows of steel bars at the periphery are completely bound. Steel tie bars with a diameter Φ of 8 mm needs to be arranged between reinforcing meshes of the shear wall and arrayed in a quincuncial shape, and external main load-bearing steel bars must be hooked by these steel tie bars. When horizontal bars of the shear wall are anchored with a concealed column, attention must be paid to the orientation of these bars.

(5) Designing and mounting a wallboard inside formwork 10 and a beam slab formwork 11 of the cylinder. The wallboard inside formwork of the core cylinder is assembled on the spot according to a method of holding by bamboo plywood and longitudinal and transverse steel cylinders, and a square timber with a size of 48 mm×70 mm is pressed by nails at the joint of the formworks to ensure tight and flat joint. The inside formwork and the outside formwork are connected via crossing screws. In supporting of the beam slab formwork, the longitudinal spacing between vertical rods of a formwork support 12 is not greater than 1 m and the transverse spacing is not greater than 1 m, and long steel cylinders at the beam bottom cannot be jointed between the vertical rods via joint fasteners, in order to prevent beam sinking caused by concrete casting. A longitudinal diagonal bracing should be arranged on the four sides and the middle part of the formwork support every four rows of vertical rods of the support, and the diagonal bracings are continuously arranged from bottom to top. For the formwork support that is higher than 4 meters, a horizontal diagonal bracing is arranged on its two ends and middle part every 4 rows of vertical rods, and this arrangement starts from the top layer and continues downwardly every 2 steps. The core cylinder is cast and compacted together with wall through the beam slab, thus the sequence of formwork construction should be: reinforcement of the wall formwork→laying at the beam bottom→beam side plate→beam column joints→platform panel. This could guarantee not only accurate axis locations of the beam columns, but also good assembly quality of the beam column joints, in addition, the operation sequence below is strictly not allowed: laying of the beam slab formwork at first, then sealing of the wallboard formwork, and finally assembly of the beam column joints.

(6) Climbing of the climbing formwork system at the outer side of the cylinder, and formwork closing. After the strength of the outer wall concrete of the cylinder at the lower layer meets the requirement of formwork stripping and the compressive strength reaches 10 Mpa or above, the wallboard outside formwork 13 is horizontally moved out of this layer by moving the large formwork moving trolley of the climbing formwork system, and the crossing bolt and the wall-attaching device are mounted at the location of the embedded steel sleeve at this layer, afterwards, the electro-control hydraulic lifting system is operated to enable the H-shaped guide rail to climb from the more lower layer to this layer and to be fixed with the wall-attaching device at this layer, then the electro-control hydraulic lifting system is operated again to also enable the scaffold body to climb up by one layer along the H-shaped guide rail through the climbing mechanism and to be fixed with the wall-attaching device, the wallboard outside formwork correspondingly ascends from the lower layer to the upper layer at which the steel bars are properly bound, the large formwork moving trolley is moved to horizontally move the wallboard outside formwork towards the wallboard, closing of the wallboard inside and outside formworks is completed when the wallboard outside formwork is moved to a designated location, and during closing, the outer wall steel back ridge plywood large formwork is connected and fixed with the back ridges on the wallboard inside formwork of the cylinder by a crossing bolt having a diameter Φ of 12 mm;

(7) Binding the steel bars 14 of the beam slab of the cylinder. Spacer bars among the steel bars of the beam slab are bound at first, line drawing and classification are carried out on these bars, after that, carrying bars and structural bars of the beam slab are bound one by one. Deformation of slab bars is liable to occur during construction because of treading on them, foot braces and concrete blocks need to be arranged on the slab bars to prevent displacement of the steel bars in the construction process, the spacing between the foot braces is 2.5 meters, and ordered binding of the steel bars is required. During binding of the beam steel bars, principal carrying bars are laid at first and then secondary carrying bars and erection bars are laid, line drawing and classification are carried out on these bars, and stirrups are bound. The joints and the anchoring length of the steel bars should be in conformity with the design and standard requirements, and joint locations should be mutually staggered in accordance with the standard requirement.

(8) Casting and compacting as well as curing of the concrete 15 of the core cylinder. Casting of beam and slab concrete: steel bars on the upper part of the beam slab should not be treaded on during casting for the beam slab; prior to casting, rebar chairs should be arranged to set up a pedestrian path and an operating platform, and direct tread on the steel bars is strictly prohibited. The pedestrian path is dismantled while broken. A vibrator needs to be compacted by vibration, and calendering is carried out while breaking. Concrete casting and compacting should be carried out in a direction parallel to the secondary beam direction in a continuous way, and time interval should be controlled within two hours. Casting of wallboard concrete: concrete is cast to the top of the shear wall at a time, and the principle of "fast insertion and slow pullout" is followed strictly during vibration. The vibration time at each vibration site is from 20 seconds to 30 seconds in general, and is not smaller than 10 seconds if a high speed vibrator is used, however, this vibration should be stopped when the surface of concrete is level without obvious sinking, bubbles no longer appear, and mortar emerges on the surface of concrete. Concrete curing: concrete should be watered for curing within 12 hours after casting. After formwork removal, vertical concrete in wall columns is encased in jute bags and then watered for curing, concrete in horizontal structures like beam slab is water-retained for curing, and meanwhile, by a spray nozzle, water is sprayed upwards to the bottom surface of the beam slab for curing.

In the construction process of the construction method for the high-rise steel structure building reinforced concrete cylinder, more attention needs to be paid to quality and safety control, which is described below in details:

During manufacturing of the formwork system, machining must be carried out in accordance with the requirements of a formwork detailing drawing, acceptance inspection must be strengthened, the preassembly procedure is carried out to ensure flatness and rigidity of the formworks before they are in place, and all the set-shaped formworks must be assigned with different areas and respectively numbered for the purpose of discrimination, which is more favorable for fast and convenient mounting and dismantling operations of the formworks. To avoid outward bulging at the junction of concrete walls, side formworks must be firmed against the top by means of horizontal supports, diagonal bracing battens with a size of 50 mm×50 mm are placed on the upper opening of the formwork, and limiters are welded on the lower opening and the crossing screws of the formwork.

The formwork on wall surface should be assembled to achieve good flatness, diagonal bracings are adopted for firm support between walls, split bolts for wall body are arranged in strict accordance with the construction scheme, and nuts are tightened to guarantee no formwork burst. The concrete casting height should be controlled within the allowed range.

During casting of the beam and slab concrete, strict control over the surface elevation of platform concrete and the thickness of a platform board must be performed; on the platform surface, leveled platform surface elevation control marks are unified by measurement/paying-off personnel within a 1500 mm range of two-way spacing, a worker in charge of dealing with the end location uses a leveling ruler, which is 2 meters long, to level the platform surface by beating according to the control marks, then the platform surface is polished twice by fine wood chips depending on the drying and hardening condition of concrete, in order to ensure good end-location quality of the platform board concrete, and finally, curing measures are taken properly and timely based upon seasonal weather conditions.

After the hydraulic mutual-type adhesive lifting scaffold creeping formwork system is mounted, the fastener bolts must be definitely tightened without looseness and slippage, and the minimal distance at the opening is not smaller than 5 mm.

A constructor in charge of the climbing formwork-climbing frame project must draw up written operational requirements in accordance with the requirements of the climbing formwork-climbing frame construction scheme and conduct technical disclosure and safety technique disclosure together with the team; the team must perform construction in strict accordance with the operational requirements and the safety technique disclosure. After being set up, the climbing formwork-climbing frame shall be managed by designated personnel and cannot be changed without authorization from the Safety Department.

The façade of the external scaffold is fully closed by a fine mesh safety vertical net and a bottom pocket at the bottom layer. The external safety net needs to be level with the scaffold by drawing, net sides are securely fastened, and the junction of the two nets is so tight that they do not float in the wind.

No movable material is allowed on the scaffold body, e.g. fasteners, waste scaffold boards, movable steel cylinders, steel bars, small steel formworks, etc.

The climbing formwork-climbing frame should be inspected and maintained by dedicated personnel on a regular basis. Given below are items that need to be inspected and maintained:

1. Whether mounting of the rods at major joints and structure of the unloading diagonal members meet the requirements in construction specification;

2. Whether the fastener bolts are in a loose state;

3. The allowable deviation for the perpendicularity of the vertical rods of the scaffold must not be 1/200 of their height, and is not greater than 70 mm.

4. Whether safety measures are in conformity with the requirements.

Overall inspection must be carried out on the climbing formwork-climbing frame in case of the followings: after strong wind on the sixth scale or above and heavy rain; anti-slip measures should be taken before getting on the climbing formwork-climbing frame after a rainy and snowy weather.

The invention claimed is:

1. A constructing method for a concrete cylinder of a construction steel bar of a high-rise steel structure, characterized by comprising:

(1) arranging a hydraulic mutual-type adhesive lifting scaffold creeping formwork system, the climbing formwork system comprising an attaching device, an H-shaped guide rail, a scaffold body, a large formwork supporting system, a large formwork moving trolley, a climbing mechanism, an electro-control hydraulic lifting system, anti-overturning and anti-falling devices and a safeguard system;

(2) manufacturing an outer wall steel back ridge plywood large formwork of the cylinder;

(3) mounting the climbing formwork system at the outer side of the cylinder;

(4) binding the wallboard steel bars of the cylinder;

(5) mounting a wallboard inside formwork and a beam slab formwork of the cylinder, the wallboard inside formwork having back ridges;

(6) the climbing formwork system climbing at the outer side of the cylinder, mounting a wallboard outside formwork of the cylinder, and closing the wallboard inside and outside formworks, wherein the wallboard outside formwork of the cylinder is the outer wall steel back ridge plywood large formwork;

(7) binding the steel bars of the beam slab; and (8) carrying out concrete casting and compacting as well as concrete curing on the wallboard and the beam slab of the cylinder;

the span of two adjacent positions is not more than 6 meters when the climbing formwork system is arranged linearly, and is not greater than 5.4 meters when the climbing formwork system is arranged in the form of a fold line or a curve; the scaffold body is either integrated or assembled, the cantilever length of the scaffold body is smaller than a half of the span of the scaffold body and must be not greater than 3 meters when the scaffold body is integrated and is not greater than ¼ of the span when the scaffold body is assembled; the total height of the scaffold body is 16 meters, which meets the requirement of an enclosure of 3.5-4 standard layers and the construction requirement;

the outer wall steel back ridge plywood large formwork in step 2 is manufactured in such a manner that 10# channel steel and a square timber with a size of 100 mm×100 mm are used as back ridges to cover a plywood with a size of 915 mm×1830 mm×18 mm, and a square timber with a size of 48 mm×70 mm is held at the joint of the large formworks;

in step 3, the H-shaped guide rail and the scaffold body of the climbing formwork system are mounted on the wallboard of the cylinder by the attaching device, so as to complete mounting of the climbing formwork system; the attaching device comprises an embedded steel sleeve, a crossing bolt and a wall-attaching device; step of mounting the scaffold body of the climbing formwork system by the attaching device is as follows: if the climbing formwork system needs to be mounted on a certain layer of the cylinder, a steel sleeve with a size of Φ60 mm×2.5 mm is embedded at the location 600 mm below structural floor when the steel bars of the wallboard or the beam slab at this layer are bound, the steel sleeve is filled with foams, two ends of the steel sleeve are sealed by adhesive tapes, and the length of the steel sleeve is identical to the thickness of the wallboard at the embedment location; after the civil structure of this layer is finished, an M48 crossing bolt is mounted at the embedded steel sleeve once the compressive strength of concrete reaches 10 Mpa or above, the inner side of the crossing bolt is fixed on the wallboard of the cylinder through a nut, the outer side of the crossing bolt is fixed with the wall-attaching device through a nut; and the H-shaped guide rail and the scaffold body of the climbing formwork system are fixed at the outer side of the wallboard of the cylinder at this layer through the wall-attaching device;

binding the wallboard steel bars in step 4 is implemented by using the scaffold body of the climbing formwork system as an operating frame;

the support structure for the wallboard inside formwork and the beam slab formwork in step 5 is set up using a steel cylinder fastener-type scaffold, and both the wallboard inside formwork and the beam slab formwork are plywoods;

step 6 specifically comprises that: after the strength of the outer wall concrete of the cylinder at the lower layer meets the requirement of formwork stripping and the compressive strength reaches 10 Mpa or above, the wallboard outside formwork is horizontally moved out of this layer by moving the large formwork moving trolley of the climbing formwork system, and the crossing bolt and the wall-attaching device are mounted at the location of the embedded steel sleeve at this layer, afterwards, the electro-control hydraulic lifting system is operated to enable the H-shaped guide rail to climb from the more lower layer to this layer and to be fixed with the wall-attaching device at this layer, then the electro-control hydraulic lifting system is operated again to also enable the scaffold body to climb up by one layer along the H-shaped guide rail through the climbing mechanism and to be fixed with the wall-attaching device, the wallboard outside formwork correspondingly ascends from the lower layer to the upper layer at which the steel bars are properly bound, the large formwork moving trolley is moved to horizontally move the wallboard outside formwork towards the wallboard, closing of the wallboard inside and outside formworks is completed when the wallboard outside formwork is moved to a designated location, and during closing, the outer wall steel back ridge plywood large formwork is connected and fixed with the back ridges on the wallboard inside formwork of the cylinder by a crossing bolt having a diameter Φ of 12 mm;

binding the steel bars of the beam slab of the cylinder in step 7 is implemented by using the scaffold body of the climbing formwork system as a circumferential protection frame.

* * * * *